United States Patent [19]

Sato

[11] 4,144,188

[45] Mar. 13, 1979

[54] TABLET FOR PREVENTING DETERIORATION OF A WATER-SOLUBLE CUTTING LIQUID

[76] Inventor: Kozo Sato, No. 7-12, Minami-3-chome, Yamamoto-cho, Yao-shi, Osaka-fu, Japan

[21] Appl. No.: 859,103

[22] Filed: Dec. 9, 1977

Related U.S. Application Data

[63] Continuation-in-part of Ser. No. 713,873, Aug. 12, 1976, abandoned.

[51] Int. Cl.[2] ..... C23F 11/14

[52] U.S. Cl. ..... 252/389 R; 156/642; 210/58; 252/79.1; 252/148; 252/392; 422/7

[58] Field of Search ..... 252/389 R, 390, 392, 252/394, 396, 148, 79.1, 79.2, 79.3, 79.4, 79.5; 156/642; 210/58

[56] References Cited

U.S. PATENT DOCUMENTS

| | | | |
|---|---|---|---|
| 2,888,401 | 5/1959 | Hughes et al. | 252/396 |
| 3,219,657 | 11/1965 | Gaertner | 252/396 |
| 3,260,673 | 7/1966 | Fisher | 252/148 |
| 3,573,225 | 3/1971 | Kondo et al. | 252/396 |
| 3,642,652 | 2/1972 | Birgy | 252/389 R |
| 3,699,052 | 10/1972 | Petrey et al. | 252/389 R |
| 3,850,823 | 11/1974 | Kjonaas | 252/389 R |
| 3,897,349 | 7/1975 | Marin et al. | 252/389 R |

*Primary Examiner*—Benjamin R. Padgett
*Assistant Examiner*—Irwin Gluck
*Attorney, Agent, or Firm*—Wenderoth, Lind & Ponack

[57] ABSTRACT

A tablet which gradually dissolves in a water-soluble cutting liquid over a long period of time for preventing deterioration thereof comprises 15 to 25% by weight of mixed primary amides of a fatty acid and a naphthenic acid, 5 to 15% by weight of ethylenediaminetetraacetic acid tetra sodium salt, 5 to 15% by weight of a lower alkyl borate, 30 to 50% by weight of at least one fatty acid derivative selected from the group consisting of esters and alkanolamine salts, and 10 to 25% by weight of an alkali nitrite.

2 Claims, 4 Drawing Figures

TABLET FOR PREVENTING DETERIORATION OF A WATER-SOLUBLE CUTTING LIQUID

This is a continuation-in-part of U.S. patent application Ser. No. 713,873, filed Aug. 12, 1976, now abandoned.

The present invention relates to a tablet which gradually dissolves in a water-soluble cutting liquid for preventing deterioration thereof.

A water-soluble cutting liquid is used as a coolant in grinding or cutting operations. Since a cutting liquid has generally a short duration of use, it should be very often exchanged. The discarded waste cutting liquid inevitably pollutes river or the like.

There are various factors causing the deterioration of a cutting liquid as described below:

(1) The effectiveness and duration of a cutting liquid are reduced by the action of external factors such as chips resulting from grinding or cutting a wordpiece, grainy refuse ground off from a grindstone, lubricating oil or grease for machine tools, dust and bacteria, oxides thermally produced by friction between tools and worpieces, ions such as calcium, magnesium and others in hard water when it is used as a diluent for a cutting liquid concentrate.

(2) The effectiveness and duration of a cutting liquid are also reduced by external factors, that is, the effective ingredients in a cutting liquid are hydrolyzed with the lapse of time. The deterioration of a cutting liquid due to the hydrolysis ceaselessly advances even during the stoppage of the machine tools, different from the external factors mentioned above.

A cutting oil and other non-water-soluble cutting liquid are free from being affected by these internal factors, and have a longer life. A water-soluble cutting liquid has, however, the highest efficiency at the very time when a cutting liquid concentrate is diluted with water, and thereafter, the effectiveness is gradually reduced in the course of time. The deteriorated cutting liquid should be exchanged. Therefore, the shorter the exchange cycle, the more the drainage.

In order to eliminate the deterioration of a water-soluble cutting liquid caused by the external factors, the contamination such as chips, oxides and other solids in a waste cutting liquid are filtered off by means of magnetic filtration, paper or cloth filtration, centrifugal separation and others. However, these treatments of the waste cutting liquid are not effective for recovery of the effectiveness lost due to the internal factors.

In consideration of the above, the inventor has reached an idea that the effectiveness of a cutting liquid could be maintained by the addition of an additive which continuously compensates the reduced effectiveness over a long term. As a result of further studies on the lines, the inventor has reached a second idea that the additive should be a solid which gradually dissolves in a cutting liquid of which effectiveness is decreasing on the other hand by the hydrolysis of the effective ingredients.

A primary object of the present invention is, therefore, to solve the abovementioned problem, and more specifically, to provide a tablet which gradually dissolves in a cutting liquid for maintaining the the effectiveness thereof for a long term so as to increase its duration.

Other objects and features of the present invention will be apparent from the following description of the invention with reference to the accompanying drawings, in which.

Figure 1:
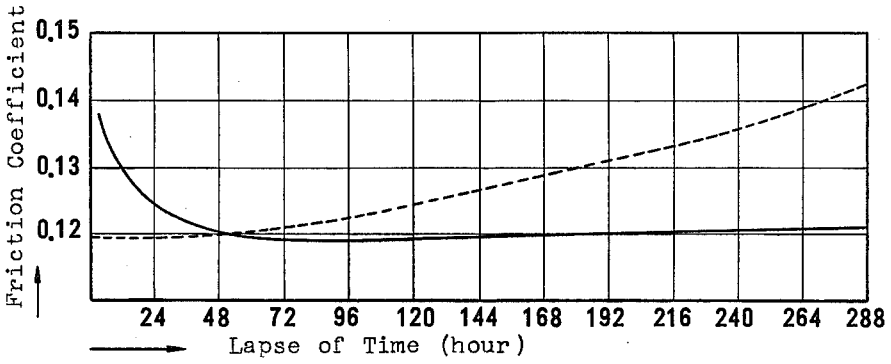
FIG. 1 is a graph showing a friction coefficient of a cutting liquid with the lapse of time.

The tablet of the invention comprises 15 to 25% by weight of primary amides derived from a mixture of at least one fatty acid having 15 to 18 carbon atoms per molecule and a naphthenic acid having 10 to 12 carbon atoms per molecule, 5 to 15% by weight of ethylenediaminetetraacetic acid tetra sodium salt, 5 to 15% by weight of at least one boric acid ester of an alcohol selected from the group consisting of methyl and ethyl alcohol, 30 to 50% by weight of at least one fatty acid derivative selected from the group consisting of esters of an alcohol selected from lower alkyl alcohols, saccharose, pentaerithritol, dipentaerithritol and tripentaerithritol and salts of at least one alkanolamines having 2 to 9 carbon atoms per molecule, the precursory fatty acid of the fatty acid derivative having 15 to 18 carbon atoms per molecule, and 10 to 25% by weight of an alkali nitrite.

A mixture of the above components can be readily moulded into a tablet without any binder such as wax which might be harmful to a cutting liquid. In other words, every component in the tablet of the invention has one or more functions to keep the effectiveness of a cutting liquid at a high level by the synergistic anti-rusting, lubricating, pH-adjusting, and cleaning effects.

The tablet of the invention is, therefore, for example, produced by mixing the above components, slowly agitating at a temperature of about 50° to 80° C. for about one hour, and then rapidly cooling so as to solidify. The solid is then commuted and press-moulded into a tablet of a shape, for example, of ball with a diameter of about 30 mm under a pressure of about 5000 to 10000 kg/cm$^2$. The tablet has usually specific gravity of about 1.4 to 1.6.

It should be noted that the tablet is not adapted that it will not dissolve rapidly but dissolves slowly in a cutting liquid, releasing effective ingredients over a period of about one week to about one month until it finally disappears. Therefore, the effectiveness of the tablet of the invention is not so remarkable before about 24 hours after the addition thereof since only a small amount of the effective ingredients dissolve in a cutting liquid. However, after about 24 hours from the addition of the tablet, the effective ingredients dissolve by a suitable amount and maintain the efficiency of the cutting liquid for a long term.

A weight of the tablet of the invention is, for example, 20 g per tablet. One tablet is preferably added to 5 to 50 liters of a water-soluble cutting liquid. In practical use, certain number of the tablets are added to a cutting liquid in consideration of the above ratio.

The effective period of a single tablet is about one month and a half. After that, another tablet is added in a cutting liquid of 5 to 50 liters so as to keep the efficiency thereof.

As for the components of the tablet of the invention, the primary amides of the fatty acids and the naphthenic acid in general serve to replenish lubrication, anti-rusting and permeation properties of a cutting liquid. Various primary amides of the fatty acids having 15 to 18 carbon atoms in their molecule can be used in the invention, and more particularly, amides of castor oil fatty acids are preferable since they act as a better foam depressor. The naphthenic acid amide is also preferred since it provides high transparency and moderate dissolving rate with the tablet. Therefore, a mixture of these amides are most preferred. The primary amides can be prepared in a usual manner. For instance, a mixture of the fatty acids and the naphthenic acid is esterified, and the esterification product is then reacted with ammonia. Other typical examples of fatty acids are coconut oil fatty acids, rauric, miristic, palmitic, oleic and ricinoleic acid.

Ethylenediaminetetraccetic acid tetra sodium salt (EDTA $Na_4$) serves to soften hard water when it is used as a diluent for cutting liquid concentrate to produce a water-soluble cutting liquid.

The boric acid ester serves not only to increase anti-rusting property of a cutting liquid but also to lower the pH thereof to keep at a moderate value, about 9 for a long term. A number of boric esters can be used in the invention so far as they are moderately soluble in water. For example, there are boric esters of an aliphatic alcohol having 1 to 10 carbon atoms per molecule, among which methyl and ethyl alcohol are most preferred.

The fatty acid esters as an ingredient of the tablet function mainly as a surface active agent, and cause each component of the tablet to diffuse homogeneously into a cutting liquid. The esters also provide constant cleaning effect with a cutting liquid. The esters can be prepared in a conventional method from fatty acids such as rauric, miristic, palmitic, oleic and ricinoleic acid, coconut oil fatty acids and castor oil fatty acids, and lower alkyl alcohols such as methyl, ethyl, propyl and butyl alcohol, and/or aliphatic polyols such as mono-, di- and tripentaerithritol and a mixture thereof. Saccharose can also ne used.

The alkanolamine salts also increase anti-rusting property of a cutting liquid, and preferred example of the salts are those of fatty acids such as rauric, miristic, palmitic, oleic and ricinoleic acid, coconut oil fatty acids and castor oil fatty acids and trialkanolamines such as triethanolamine and triisopropanolamine.

The alkali nitrite also serves to increase anti-rusting property of a cutting liquid. Usually sodium or potassium nitrite is used.

A cutting liquid was heretofore adandoned as drainage and was completely exchanged after about two months from the start of using a fresh cutting liquid. That is, the shorter the duration of use of a cutting liquid, the more frequently the liquid should be exchanged, resulting in increase of drainage, as mentioned before. However, when several tablets of the invention are added to a cutting liquid at intervals, it can be used for about one year, rendering unnecessary the whole and frequent exchange of the waste cutting liquid. Therefore, drainage is remarkably reduced and pollution of rivers or the like is also remarkably reduced.

The present invention is illustrated by the following examples.

EXAMPLE 1

Under a pressure of 8000 kg/cm$^2$ were moulded several ball-like tablets with a diameter of about 30 mm, weighing about 20 g. The following table shows the composition of each of the sample tablets.

A cutting liquid was prepared by dissolving in water a commercially available cutting liquid concentrate which mainly comprises a mixture of higher and lower fatty acids and amines together with some other ingredients, and was used in a usual cutting operation to obtain a waste cutting liquid.

A test piece of cast iron of 30 mm × 30 mm was immersed in the waste cutting liquid and immediately taken out for exposure to the atmosphere so as to observe rust formation on the surface of the test piece.

As a blank test, the test piece was immersed in the waste cutting liquid containing no additive of the invention, resulting in immediate rust formation substantially on the whole surface of the test piece.

However, the same experiments on 6 liters of the waste cutting liquid to which one tablet of the invention has been added 24 hours before the immersion and exposure were performed, and rust did not appear but appeared after 5 minutes or more, as shown in the Table.

| COMPOSITION (weight %) | SAMPLE 1 | 2 | 3 | 4 | 5 | 6 | 7 |
|---|---|---|---|---|---|---|---|
| Fatty acid amides*1 | 15 | 15 | 20 | 20 | 20 | 20 | 25 |
| EDTA $Na_4$ | 5 | 10 | 5 | 10 | 15 | 15 | 10 |
| Ethyl borate | 15 | 15 | 5 | 10 | 15 | 10 | 10 |
| Fatty acid esters of monoalcohol*2 | 20 | 20 | 20 | 20 | 15 | 15 | 25 |
| Fatty acid esters of polyalcohol*3 | 25 | 20 | 25 | 20 | 15 | 20 | 10 |
| $NaNO_2$ | 20 | 20 | 25 | 20 | 20 | 20 | 20 |
| Solubility (days)*4 | 7 | 16 | 9 | 25 | 10 | 13 | 14 |
| Rusting (time)*5 | 8'40" | 6'40" | >10' | 8'40" | 9'10" | 5'40" | 5'40" |

Note:
*1Prepared by the esterification of a 1:1:2 by weight mixture of oleic acid, a naphthenic acid mainly of 11 carbon atoms per molecule and castor oil fatty acids, and then by the reaction of the esterification product with ammonia.
*2A 2:1 by weight mixture of castor oil fatty acid ester of ethyl alcohol and butyl oleate.
*3A 2:1 by weight mixture of oleic acid ester of dipentaerithritol and castor oil fatty acids ester of monopentaerithritol.
*4Days required for substantially complete dissolving of the tablet in a fresh cutting liquid.
*5Time required for forming the first point rust on the test piece immersed in and taken out of 5 litres pf the waste cutting liquid to which one tablet had been added 24 hours before.

EXAMPLE 2

Sample 8, a ball-like tablet with a diameter of 30 mm, weighing 20 g and of specific gravity of 1.58 was prepared by press-moulding under pressure of 8000 kg/cm$^2$ from the mix of 20 weight % of acid amides produced from the esters of a 1:1:3 by weight mixture of oleic, a naphthenic mainly of 11 carbon atoms per molecule and castor oil fatty acids, 10 weight % of EDTA $Na_4$, 10 weight % of ethyl borate, 20 weight % of oleic acid ester of pentaerithritol, 30 weight % of trietanolamine salts of a 3:2 by weight mixture of castor oil fatty acids and oleic acid, and 10 weight % of sodium nitrite.

This tablet was added to 6 liters of a waste cutting liquid prepared in the same manner as Example 1, and the changes of the friction coefficient, anti-rusting property and pH of the cutting liquid were examined in comparison with those of a fresh cutting liquid.

In FIG. 1, the dotted line shows the friction coefficient of the fresh cutting liquid which was increased due to the hydrolysis of the cutting liquid as the time went by. The waste cutting liquid to which the tablet had been added recovered a low friction coefficient as the fresh cutting liquid originally had after about 48 hours from the addition of the tablet.

Figure 2:
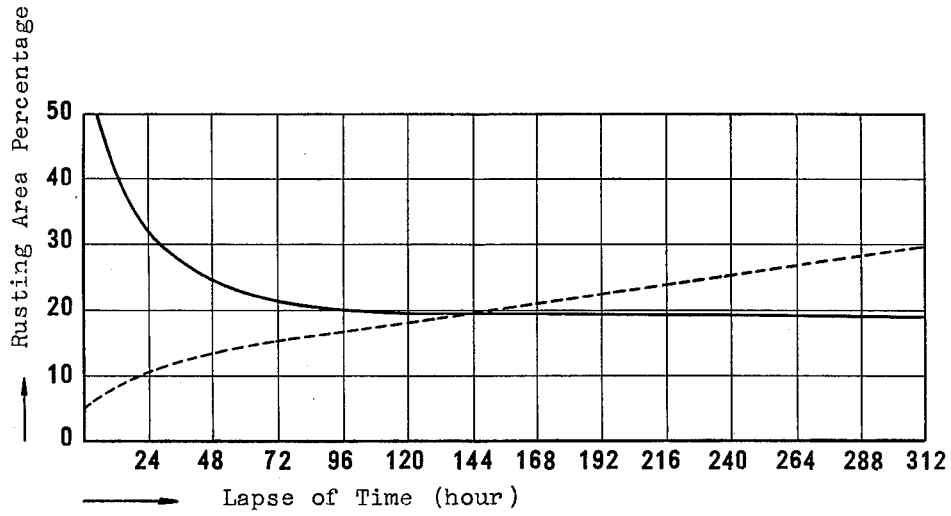
FIG. 2 is a graph showing an anti-rusting property of a cutting liquid with the lapse of time.

FIG. 2 shows rusting area percentage determined according to (rusted area/total area) × 100 on the surface of a test piece of cast iron of 30 mm × 30 mm which was immersed in and immediately taken out of the waste cutting liquid. The dotted line shows that anti-rusting property of a fresh cutting liquid decreasing with the lapse of time due to the hydrolysis of the cutting liquid. However, as shown by the solid line, the waste cutting liquid containing the tablet soon recovered its original, high anti-rusting property.

Figure 3:
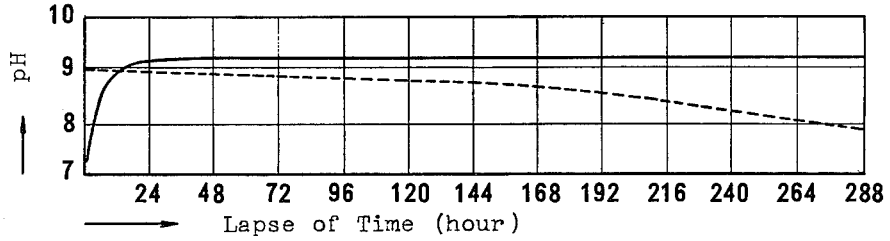
FIG. 3 is a graph showing a pH value of a cutting liquid with the lapse of time.

The dotted line in FIG. 3 shows the pH of a fresh cutting liquid, which decreased with the lapse of time due to the hydrolysis. The solid line shows that the pH of the waste cutting liquid containing the tablet of the invention rose rapidly and was kept at about 9.

Figure 4:
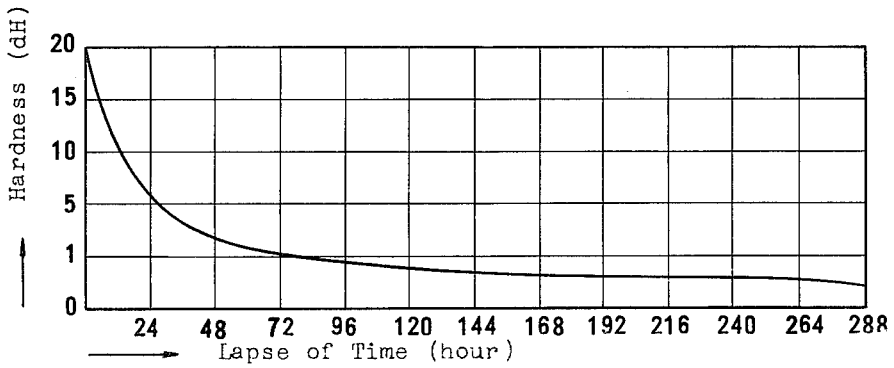
FIG. 4 is a graph showing a hardness decrease of a hard water of 20° dH added with the tablet of the present invention.

FIG. 4 shows softening effect of the tablet of the invention. One tablet was added to 6 liters of hard water of 20 dH hardness. The hardness was measured at intervals, revealing that the water is softened as the time lapses.

EXAMPLE 3

Other tablets were prepared of the composition as below:

| Sample 9 | |
|---|---|
| Primary amides of a 1:1:2 by weight mixture of palmitic acid, a naphthenic acid mainly of 11 carbon atoms per molecule and castor oil fatty acids | 20 weight % |
| EDTA $Na_4$ | 10 weight % |
| Ethyl borate | 10 weight % |
| A 1:1:2 by weight mixture of castor oil fatty acids ester of ethyl alcohol, butyl oleate and oleic acid ester of saccharose | 20 weight % |
| A 1:1:2 by weight mixture of oleic acid ester of dipentaerithritol, stearic acid ester of pentaerithritol and castor oil fatty acid ester of pentaerithritol | 20 weight % |
| Sodium nitrite | 20 weight % |

-continued

| Sample 10 | |
|---|---|
| Primary amides of a 1:1:2 by weight mixture of oleic, a naphthenic acid mainly of 11 carbo atoms per molecule and castor oil fatty acids | 20 weight % |
| EDTA $Na_4$ | 10 weight % |
| A 1:1 by weight mixture of methyl and ethyl borate | 10 weight % |
| A 2:1:1 by weight mixture of castor oil fatty acids ester of ethyl alcohol, butyl oleate and coconut oil fatty acids ester of ethyl alcohol | 20 weight % |
| A 1:1:2 by weight mixture of oleic acid ester of pentaerithritol, stearic acid ester of pentaerithritol and castor oil fatty acids ester of pentaerithritol | 20 weight % |
| Potassium nitrite | 20 weight % |

The samples 9 and 10 also provided substantially the same effectiveness with the waste cutting liquid as sample 8 in Example 2.

What is claimed is:

1. A tablet which gradually dissolves in a water-soluble cutting liquid over a long period for preventing deterioration thereof comprising 15 to 25 weight % of mixed primary amides of at least one fatty acid having 15 to 18 carbon atoms per molecule and a naphthenic acid having 10 to 12 carbon atoms per molecule, 5 to 15 weight % of ethylenediaminetetraacetic acid tetrasodium salt, 5 to 15 weight % of at least one boric acid ester of an alcohol selected from the group consisting of methyl alcohol and ethyl alcohol, 30 to 50 weight % of at least one fatty acid derivative selected from the group consisting of fatty acid esters of an alcohol selected from the group consisting of lower alkyl alcohols, saccharose, pentaerithritol, dipentaerithritol and tripentaerithritol and salts of at least one alkanolamines having 2 to 9 carbon atoms per molecule, the precursory fatty acid of the fatty acid derivative having 15 to 18 carbon atoms per molecule, and 10 to 15 weight % of a nitrite of at leat one alkali metal selected from the group consisting of sodium and potassium.

2. A tablet as claimed in claim 1, wherein the alkanolamine is triethanolamine.

* * * * *